US011027285B2

(12) United States Patent
Ha

(10) Patent No.: US 11,027,285 B2
(45) Date of Patent: Jun. 8, 2021

(54) VERTICAL SHAFT IMPACT CRUSHER AND ROTOR THEREOF

(71) Applicant: Yong-Gan Ha, Chungcheongbuk-do (KR)

(72) Inventor: Yong-Gan Ha, Chungcheongbuk-do (KR)

( * ) Notice: Subject to any disclaimer, the term of this patent is extended or adjusted under 35 U.S.C. 154(b) by 573 days.

(21) Appl. No.: 15/318,040

(22) PCT Filed: Jun. 10, 2015

(86) PCT No.: PCT/KR2015/005824

§ 371 (c)(1),
(2) Date: Dec. 12, 2016

(87) PCT Pub. No.: WO2015/190825

PCT Pub. Date: Dec. 17, 2015

(65) Prior Publication Data

US 2017/0106374 A1 Apr. 20, 2017

(30) Foreign Application Priority Data

Jun. 11, 2014 (KR) ..... 10-2014-0070685

(51) Int. Cl.
*B02C 13/18* (2006.01)
*B02C 13/09* (2006.01)
(Continued)

(52) U.S. Cl.
CPC ..... *B02C 13/1835* (2013.01); *B02C 13/09* (2013.01); *B02C 13/14* (2013.01);
(Continued)

(58) Field of Classification Search
CPC . B02C 13/14; B02C 13/1842; B02C 13/2804; B02C 19/00; B02C 13/09;
(Continued)

(56) References Cited

U.S. PATENT DOCUMENTS 3,768,209 A * 10/1973 Punter ..... B24C 5/06 451/97
3,995,784 A * 12/1976 de los Santos Izquierdo ..... B02C 13/1835 241/275

(Continued)

FOREIGN PATENT DOCUMENTS

FR 1599449 B2 8/1970
JP S60-150847 A 8/1985

(Continued)

OTHER PUBLICATIONS

Extended European Search Report dated Oct. 17, 2017 from European Patent Office in connection with the counterpart European Patent Application No. 15806925.2, citing the above reference(s).

(Continued)

*Primary Examiner* — Ghassem Alie
*Assistant Examiner* — Nhat Chieu Q Do

(57) ABSTRACT

The present disclosure relates to a vertical shaft impact crusher comprising a rotor having a rotor protection layer which consists of particles of objects to be crushed. The rotor includes at least: a rotor upper plate comprising a rotor upper plate hole, which is an inlet for the object for crushing which is inserted into the rotor; a rotor lower plate disposed to be separated from the lower portion of the rotor upper plate; a rotor upper plate; a rotor side wall disposed between the rotor upper plate and the rotor lower plate and coupled to the rotor upper plate and the rotor lower plate, the rotor side wall being disposed at a position spaced from the rotation center of the rotor; and a circular hole which is formed on the rotor side wall and is an outlet for the object for crushing accelerated by the rotor to come out of the rotor.

19 Claims, 9 Drawing Sheets

(51) Int. Cl.
*B02C 13/14* (2006.01)
*B02C 13/28* (2006.01)
*B02C 13/286* (2006.01)

(52) U.S. Cl.
CPC ..... *B02C 13/1807* (2013.01); *B02C 13/1842* (2013.01); *B02C 13/2804* (2013.01); *B02C 2013/28681* (2013.01); *B02C 2210/02* (2013.01)

(58) Field of Classification Search
CPC ..... B02C 13/1807; B02C 13/18; B02C 13/28; B02C 13/286
USPC ..... 241/275
See application file for complete search history.

(56) References Cited

U.S. PATENT DOCUMENTS

| | | | | |
|---|---|---|---|---|
| 4,513,919 | A | 4/1985 | Terrenzio | |
| 5,806,774 | A | 9/1998 | Vis | |
| 5,863,006 | A | 1/1999 | Thrasher | |
| 6,032,889 | A * | 3/2000 | Thrasher | B02C 13/1835 241/275 |
| 7,854,407 | B2 * | 12/2010 | Potter | B02C 13/30 241/275 |
| 8,020,791 | B2 * | 9/2011 | Knueven | B02C 13/1807 241/275 |
| 8,272,247 | B2 * | 9/2012 | Kojovic | G01N 3/48 73/12.11 |
| 8,632,029 | B1 * | 1/2014 | Cato | B02C 19/0025 241/275 |
| 2005/0269438 | A1 | 12/2005 | Dallimore | |
| 2007/0295844 | A1 | 12/2007 | Ha | |
| 2009/0194623 | A1 | 8/2009 | Knueven et al. | |

FOREIGN PATENT DOCUMENTS

| | | | |
|---|---|---|---|
| JP | 07-080333 | A | 3/1995 |
| JP | 2003-290675 | A | 10/2003 |
| KR | 1997-0061364 | A | 9/1997 |
| KR | 10-0545788 | B1 | 1/2006 |
| KR | 10-2013-0013913 | A | 2/2013 |
| KR | 20-2013-0006306 | U | 10/2013 |

OTHER PUBLICATIONS

Japanese Office Action dated Oct. 31, 2017 from JPO in connection with the counterpart Japanese Patent Application No. 2017-518022, citing the above reference(s).
International Search Report dated Sep. 16, 2015 corresponding to International Application No. PCT/KR2015/005824, citing the above reference(s).
Japanese Office Action dated Oct. 2, 2018, in connection with the Japanese Patent Application No. 2017-518022 citing the above reference(s).

* cited by examiner

VERTICAL SHAFT IMPACT CRUSHER AND ROTOR THEREOF

CROSS REFERENCE TO RELATED APPLICATION

This application claims the priority of Korean Patent Application No. 10-2014-0070685, filed on Jun. 11, 2014 in the KIPO (Korean Intellectual Property Office). Further, this application is the National Phase application of International Application No. PCT/KR2015/005824 filed Jun. 10, 2015, which designates the United States and was published in Korean. Both of the priority documents are hereby incorporated by reference in their entireties.

TECHNICAL FIELD

The present invention relates to a vertical shaft impact crusher which accelerates a rock or a mineral by a rotor, which is installed on the upper end of a vertical shaft rotating at a high speed, to a high speed such that the rock or mineral collides with a stationary wall to be crushed and, more specifically, to a vertical shaft impact crusher including a rotor protective layer which is made of particles of a crushed object and formed inside the rotor.

BACKGROUND ART

A machine, which crushes a rock or a mineral not by using a compression force but by using an impact force generated when the rock or mineral collides with an object at a relative speed with respect to the object, is called an impact crusher. There are many kinds of impact crushers and the impact crushers are widely used in industrial fields.

Among them, a machine, which has a vertical shaft rotating at a high speed and a rotator installed on the upper end of the vertical shaft, and crushes an object to be crushed by accelerating the object to be crushed at a high speed, when the object to be crushed is inserted into the crusher, and making the object be crushed collide with a stationary or low speed object, is called a vertical shaft impact crusher. In the vertical shaft impact crusher, the rotor is installed horizontally, and the object to be crushed is finally accelerated in a horizontal direction and comes out of the rotor to collide.

The vertical shaft impact crusher is classified into a first kind in which the object to be crushed is brought into a direct contact with an object constituting the rotor to receive the impact force, and a second kind in which a rotor protective layer made of particles of the object to be crushed is formed in the rotor and the object to be crushed touches the rotor protective layer to receive the impact force.

As for the first kind of the vertical shaft impact crusher, an impact plate constituting the rotor is worn at a high speed by a crystal component included in a rock, which restricts the use of the vertical shaft impact crusher into the use for crushing relatively large particles or the use for crushing a rock or a mineral with a very low hardness such as a limestone.

The vertical shaft impact crusher of the second kind having a rotor with a protective layer for protecting the rotor formed therein experiences less wear even when a rock or a mineral with a high hardness is crushed thanks to the existence of the protective layer, and, therefore, it is widely used for the use (e.g. production of sand) for crushing an object with relatively small particles into even smaller pieces.

However, even in the second kind of rotor, a rotor component at an end portion of the protective layer is also exposed to a severe wear, so this component is usually made of a material with a high hardness such as an extra hard alloy.

On the other hand, the extra hard alloy is very expensive and much effort is required to elongate a using lifetime of this rotor component. For example, there is a method of dividing the extra hard alloy component into 3 or 4 pieces and, when one of the pieces is worn more than the rest of them, changing an arrangement sequence of the pieces such that the extra hard alloy component, which has been worn more, is replaced with the extra hard alloy component experiencing less wear.

However, even when this method is used, troubles still remain and operation efficiency is very low since a great amount of time is needed to disassemble the components and change the arrangement sequence, and a dynamic balance of the rotor is broken after changing the arrangement sequence since a shape of the protective layer is also changed.

This will be explained in more detail by referring to FIG. 1. FIG. 1 is an illustration of a rotor used in the conventional vertical shaft impact crusher, and is shown without an upper cover of the rotor such that an inner portion of the rotor can be seen.

A rotor 80 consists of a rotor lower plate 81, a rotor side wall 82 which is partitioned into a few sections, and partitions 83. A tip portion 821 of the partitioned rotor side wall 82 in a rotating direction is formed to be thick and strong, and a concave engraved portion 8211 with a rectangular pillar-like shape is vertically formed on an outer portion of the rotor side wall such that a head (disposed outside of the side wall) of a coupling bolt 823, which couples a rotor tip plate 822 with the tip portion 821, is hidden inside the engraved portion. According to this configuration, it is possible to prevent the object to be crushed, which intermittently flies from outside the rotor back toward the rotor, from colliding with the heads of the coupling bolts and wearing the heads of the coupling bolts. Also, a planar portion 8212 is formed on an inner side surface of the tip portion 821 such that a rotor tip plate 822 with a corresponding planar shape is firmly attached to the planar portion by means of the coupling bolts 823.

A tip portion 8221 of the rotor tip plate 822 is formed to be thicker than a plate-shaped portion and a rectangular bar-shaped groove is formed on the tip portion, such that an extra hard alloy tip 8222 is fitted into the groove to be firmly engaged with the tip portion.

Particle-shaped rocks, etc. are forcefully pushed against the partition 83 by a centrifugal force, and one end (counter-rotation direction portion) and the other end (rotation direction portion) are supported by a base plate 831 of the partitions 83 and the rotor tip plate 822, respectively. The rocks, which were forcefully pushed, then form a protective layer 84 while forming a unique wave-shaped curve. This protective layer 84 deposited within the rotor comes to steadily rotate with the rotor without being accelerated toward outside of the rotor to escape from the rotor. A shape of the wave-shaped curve of the protective layer 84 is determined by an inner frictional angle between the centrifugal force and the particle-type object to be crushed.

After the protective layer 84 is formed, a rock, which is newly inserted into the rotor and accelerated by the centrifugal force, collides with the protective layer 84 and moves in the rotating direction along the curve of the protective layer 84, and then is accelerated toward outside the rotor to escape from the rotor at the other end.

The extra hard alloy tip 8222 forms a tip portion of the rotating direction portion of the protective layer 84 and is exposed to a strong wearing environment since the particles of the object to be crushed pass by the extra hard alloy tip while being forcefully pushed against it.

By the way, according to many years' observations of the inventor of this patent application using this type of rotor, the inventor found that the wear of the extra hard alloy tip 8222 never happens uniformly along a length direction of the extra hard alloy tip 8222 in a vertically elongated shape. Rather, the wear begins as shown in FIG. 2 (FIG. 2 represents an initial wear state of the extra hard alloy tip) and, although a rough position of a wear start portion (W1) can be predicted, the exact position cannot be specified. Also, when the wear begins at one end, a concave valley-like portion with a shape corresponding to a worn portion is also formed at the protective layer 84, which is formed behind the worn extra hard alloy tip portion (W1), and after this valley is formed on the protective layer, the particle-shaped object to be crushed tends to move into the valley of the protective layer 84 and move through it intensively. As a result, the extra hard alloy tip gradually experiences wear as shown in FIG. 3 (FIG. 3 is a perspective view illustrating a continuing wear state of the extra hard alloy tip), that is, the wear rapidly progresses while intensively forming a deep groove (W2) at the wear start portion in a non-uniform manner. This local wear is the biggest factor which prevents an efficient use of the extra hard alloy tip and makes the protective layer deposit in an irregular shape, which incurs a strong vibration in the rotor rotating at a high speed. Therefore, the extra hard alloy tip 8222 should be replaced frequently.

In addition to the aforementioned problems, as for the rotor 80, since the object to be crushed, which falls from an upper portion into the rotor 80, sequentially touches a distribution cone 85, falls, touches the rotor lower plate 81, and then collides with the protective layer 84 while experiencing friction, the rotor lower plate also comes to be worn very quickly. Although a few wear-resistant pad plates 86 are arranged on the rotor lower plate 81 in order to prevent this wear, these plates also need to be replaced frequently, which raises a manufacturing cost and lowers a manufacturing efficiency.

Meanwhile, the conventional known rotors can be found in the Utility Model Publication No. 2013-6306, the Patent Registration No. 545788, the Patent Publication No. 1997-61364, and the Patent Publication No. 2013-13913, which were filed in the Korean Industrial Property Office (KIPO).

DISCLOSURE

Technical Problem

The present invention is devised to solve the problems of the conventional vertical shaft impact crusher described above which forms a protective layer inside a rotor. An objective of the present invention is to provide a rotor which can accurately control a behavior of an object to be crushed within the rotor by forming a valley-shaped protective layer uniformly at a set position, rather than enabling the protective layer to develop by occasion due to the wear of a predetermined component in the rotor, by using a phenomenon that, when the valley-shaped protective layer is formed, particles of the object to be crushed are moved into the valley and move through the valley intensively, and a vertical shaft impact crusher having the rotor.

Also, another objective of the present invention is to provide a rotor, which does not generate vibrations even when the rotor rotates at a high speed, by uniformly forming the protective layer with a shape corresponding to a center of rotation of the rotor, and a vertical shaft impact crusher having the rotor.

Furthermore, a still another objective of the present invention is to provide a rotor which is designed such that a rotor protective layer is formed in a uniform shape, and can increase economic feasibility of a wear-resistant tip by reducing the size of a wear-resistant tip itself by predicting a portion, which will be worn intensively, and enabling the wear to develop only at the predicted local portion, and maximize the utilization efficiency of the wear-resistant tip by enabling the wear-resistant tip to experience the uniform wear, and a vertical shaft impact crusher having the rotor.

In addition, a still another objective of the present invention is to provide a rotor which can be easily maintained by exposing only the components, which can be easily replaced, to the wearing environment, and a vertical shaft impact crusher having the rotor.

Also, a still another objective of the present invention is to provide a rotor having an installation configuration of a wear-resistant tip, which can be utilized to experience the uniform wear, and a vertical shaft impact crusher having the rotor.

Furthermore, a still another objective of the present invention is to provide a rotor, whose worn components are easily replaced without destructing a protective layer formed inside the rotor during a replacement process, and which can be directly utilized for crushing without a separate stabilizing process after the replacement process, and a vertical shaft impact crusher having the rotor.

In addition, a still another objective of the present invention is to provide a rotor which can not only adjust a path for the object to be crushed accurately but also adjust a wearing portion of an extra hard alloy tip accurately, by forming a small funnel-shaped protective layer at a center portion of the rotor where the object to be crushed falls from an upper portion into the rotor and touches the rotor, in order to prevent the object to be crushed from touching a bottom of the rotor before touching the protective layer formed on a rotor side wall, such that the object to be crushed is prevented from touching the rotor bottom by enabling the object to be crushed, which touches the funnel-shaped protective layer, to have a rising speed vector while gaining a small speed, and the object to be crushed, which leaves the funnel-shaped protective layer, accurately reaches the valley portion of the valley-shaped protective layer engraved on the side wall through the air, and a vertical shaft impact crusher having the rotor.

Technical Solution

In order to accomplish the aforementioned objectives, the present invention provides a rotor 5 for a vertical shaft impact crusher which rotates about a rotation shaft extending in a vertical direction and accelerates an object to be crushed by a centrifugal force, comprising: a rotor upper plate 55 including a rotor upper plate hole 551 which is an inlet for the object to be crushed, which is inserted into the rotor, and forms an upper portion of the rotor; a rotor lower plate 53 which is disposed under the rotor upper plate to be spaced apart from the rotor upper plate and forming a bottom of the rotor; a rotor side wall 54 which is arranged between the rotor upper plate and the rotor lower plate to be coupled with the rotor upper plate and the rotor lower plate, and disposed at a position spaced apart from a rotation center of the rotor; and a circular hole 541 which is formed on the rotor side wall 54 and is an outlet, through which the object to be crushed accelerated by the rotor comes out of the rotor.

The shape of the rotor should not necessarily be circular, and the rotor can take various shapes such as a triangle, a quadrangle, and a hexagon, etc. in the condition that the shapes do not cause vibration while the rotor rotates. Also, circular holes can be formed in the number corresponding to the number of edges of these polygons.

Here, the circular holes 541 can be formed at the same height equidistantly along an outer periphery of the rotor side wall 54.

Here, a wear-resistant tip with a hardness greater than that of the rotor side wall 54 can be detachably installed in a 3 o'clock direction or a 9 o'clock direction of the circular holes 541.

Here, a wear-resistant tip ring 546, which has a hardness greater than that of the rotor side wall 54 can be detachably installed at a circumference of the circular hole 541, and the wear-resistant tip ring can be installed at different azimuth angles with respect to the circular hole 541.

Here, an inner diameter of the wear-resistant tip ring 546 is configured to be smaller than an inner diameter of the circular hole 541.

Here, the wear-resistant tip ring 546 can be coupled with a wear-resistant tip ring housing 543 and the wear-resistant tip ring housing 543 can be engaged with the circumference of the circular hole 541, which results in the wear-resistant tip ring 546 being installed on the circumference of the circular hole.

Here, the wear-resistant tip ring 546 is coupled with an end portion close to a center of the rotor at an inner diameter portion of the wear-resistant tip ring housing 543.

Here, a plurality of tap holes 5421 are formed at the circumference of the circular hole, a plurality of bolt holes 5431 are also formed on the wear-resistant tip ring 546 or the wear-resistant tip ring housing 543 with which the wear-resistant tip ring housing 543 is engaged, and, even when the azimuth angle of the wear-resistant tip ring 546 or the wear-resistant tip ring housing 543 with which the wear-resistant tip ring 546 is engaged varies, at least some of the tap holes 5421 and the bolt holes 5431 are mated with one each other to engage coupling bolts 545, which can enable the wear-resistant tip ring 546 or the wear-resistant tip ring housing 543 with which the wear-resistant tip ring 546 is engaged to be installed on the circumference of the circular hole.

Here, a wear-resistant tip ring housing support ring 542, which is separably coupled with the wear-resistant tip ring 546 or the wear-resistant tip ring housing 543 with which the wear-resistant tip ring 546 is engaged, can be coupled with the rotor side wall 54 in one entity at an inner diameter portion of the circular hole 541.

Here, the wear-resistant tip ring 546 or the wear-resistant tip ring housing 543 with which the wear-resistant tip ring 546 is engaged can be engaged with the circumference of the circular hole 541 from outside the rotor side wall 54.

Here, a partition ring 544 can be sandwiched at a plane, wherein the circumference of the circular hole 541 of the rotor side wall 54 or the wear-resistant tip ring housing support ring 542, which is engaged with the circumference of circular hole 541 in one entity, and the wear-resistant tip ring 546 or the wear-resistant tip ring housing 543 with which the wear-resistant tip ring 546 is engaged faces each other with the plane between them.

Here, the rotor can be configured such that an outer diameter of the partition ring 544 is greater than the circumference of the circular hole 541 or the wear-resistant tip ring housing support ring, which is engaged with the circumference of circular hole 541, and an inner diameter of the partition ring 544 is smaller than the inner diameter of the circular hole 541 or the wear-resistant tip ring housing support ring 542, which is engaged with the circumference of the circular hole 541 in one entity, and is equal to or smaller than the inner diameter of the wear-resistant tip ring 546.

Here, the rotor can be configured such that a distribution tube 56 is installed to protrude upward at a predetermined position between the center and an end portion of the rotor lower plate 53, wherein a height of an upper end of the distribution tube 56 is lower than the center of the circular hole 541.

Here, the rotor can be configured such that the distribution tube 56 includes a lower distribution tube 561 and an upper distribution tube 562 which is separably coupled with the lower distribution tube 561.

Here a distribution tube top lining 5622 having a hardness greater than that of the distribution tube can be installed on the upper end of the distribution tube 56.

Here, the distribution tube includes a distribution tube bottom plate 5613, and a distribution tube bottom lining 5615 can be installed on a center of the distribution tube bottom plate 5613.

In addition, according to the present invention, an equilateral polygon hole 59 can be formed instead of the aforementioned circular hole 541, and the rotor can be configured such that, when viewed in a vertical direction, the rotor side wall 54 area exists at areas between the equilateral polygon hole 59 and the rotor upper plate 55 and between the equilateral polygon hole 59 and the rotor lower plate 53.

Also, along with the case with the circular hole, a wear-resistant tip ring 546, which has an equilateral polygon shape corresponding to the shape of the equilateral polygon hole 59 and is smaller than the equilateral polygon hole 59, is detachably installed to be overlapped with the equilateral polygon hole 59, and the wear-resistant tip ring can be installed at different azimuth angles with respect to the equilateral polygon hole 59.

Also, along with the case with the circular hole, the rotor can be configured such that a partition ring 544 is sandwiched at a plane, wherein the circumference of the equilateral polygon hole 59 of the rotor side wall 54 and a wear-resistant tip ring 546 or a wear-resistant tip ring housing 543, with which the wear-resistant tip ring 546 is engaged, faces each other with the plane between them, and wherein an outer periphery of the partition ring 544 is larger than the equilateral polygon hole 59, and an inner periphery of the partition ring 544 is smaller than the equilateral polygon hole 59 and equal to or greater than an inner periphery of wear-resistant tip ring 546.

Also, along with the case with the circular hole, the rotor can be configured such that a distribution tube 56 is installed to protrude upward at a predetermined position between the center and an end portion of the rotor lower plate 53, wherein a height of a top of the distribution tube 56 is lower than half the height between the rotor lower plate 53 and the rotor upper plate 55.

In addition, in order to accomplish the aforementioned objectives, the present invention provides a rotor 5 for a vertical shaft impact crusher which rotates about a rotation shaft extending in a vertical direction and accelerates an object to be crushed by a centrifugal force, comprising: a rotor upper plate 55 including a rotor upper plate hole 551 which is an inlet for the object to be crushed, which is inserted into the rotor, and forms an upper portion of the rotor; a rotor lower plate 53 which is disposed under the rotor upper plate to be spaced apart from the rotor upper plate and forms a bottom of the rotor; a rotor side wall 54 which is arranged between the rotor upper plate and the rotor lower plate to be coupled with the rotor upper plate and the rotor lower plate, and disposed at a position spaced apart from a rotation center of the rotor; a hole (541, 69) which is formed on the rotor side wall 54, wherein the object to be crushed accelerated by the rotor comes out of the rotor through the hole; and a distribution tube 56 which is installed to protrude upward at a predetermined position between a center and an end portion of the rotor lower plate 53, wherein the distribution tube 56 includes a lower distribution tube 561 and an upper distribution tube 562 or an upper ring 563 which is separably coupled with the lower distribution tube.

Here, a distribution tube top lining 5622 can be installed on the upper end of the upper distribution tube 562 or the upper ring 563.

Here, a coupling flange 5611 is formed in an outward direction on the upper end of the lower distribution tube 561, and a coupling flange 5621 or a coupling surface 5631 can be formed to correspond to the coupling flange 5611 under the upper distribution tube 562 or at an outer diameter of the upper ring 563.

In addition, in order to accomplish the aforementioned objectives, the present invention provides a vertical shaft impact crusher comprising: the aforementioned rotor; a shaft 42 which is vertically installed to be coupled under a center of the rotor and rotates in one entity with the rotor; an upper frame 11; a lower frame 12 which has a diameter smaller than that of the upper frame 11 and is installed under the upper frame 11; and a stepwise portion 111 which is installed at a diameter difference portion between the upper frame and the lower frame.

Advantageous Effects

The vertical shaft impact crusher according to the present invention has the following effects:

First, a replacement period of an expensive extra hard alloy tip is elongated by a few times.

Second, the vibration of a rotor is prevented.

Third, various portions except for a rotor aperture is prevented from being worn.

Fourth, an efficient manufacturing process can be facilitated.

Fifth, the configuration of the rotor is simple and the manufacturing cost can be reduced Sixth, the maintenance of the rotor is simple and straightforward.

Detailed effects along with the aforementioned effects of the present invention will be described while explaining the embodiments of the present invention enough such that the embodiments can be practiced.

BEST MODE

In the following, preferred embodiments of a vertical shaft impact crusher according to the present invention and a rotor used in the vertical shaft impact crusher are explained in detail by referring to the appended figures.

It is to be noted that the present invention is not restricted to the embodiments disclosed in the following and can be realized in various different configurations, and the embodiments are provided to fully disclose the present invention and help a person with an ordinary skill in the art completely understand the categories of the present invention.

Figure 1:
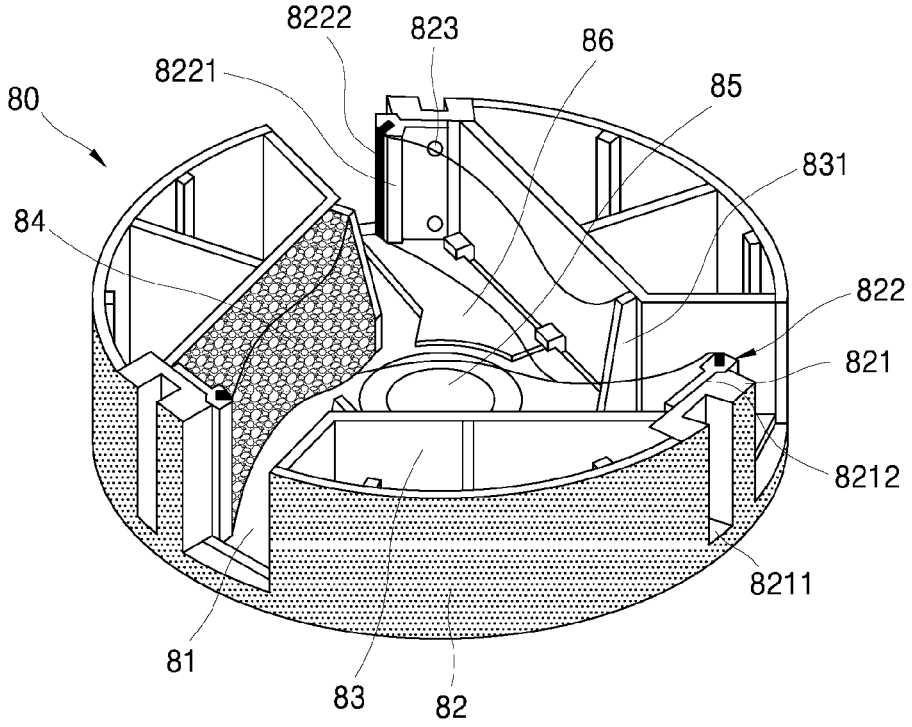
FIG. 1 is an illustration of a rotor used in the conventional vertical shaft impact crusher, and is shown without an upper cover of the rotor such that an inner portion of the rotor can be seen.
Figure 2:
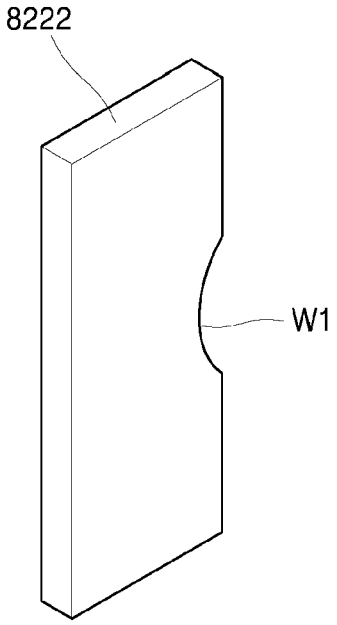
FIG. 2 is a perspective view illustrating an initial wear state of the extra hard alloy tip of FIG. 1.
Figure 3:
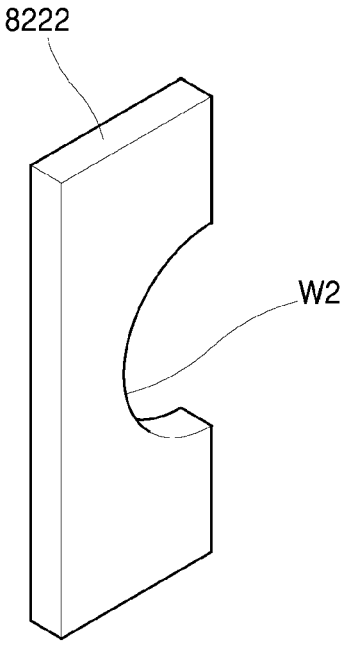
FIG. 3 is a perspective view illustrating a wear progress state of the extra hard alloy tip of FIG. 2.
Figure 4:
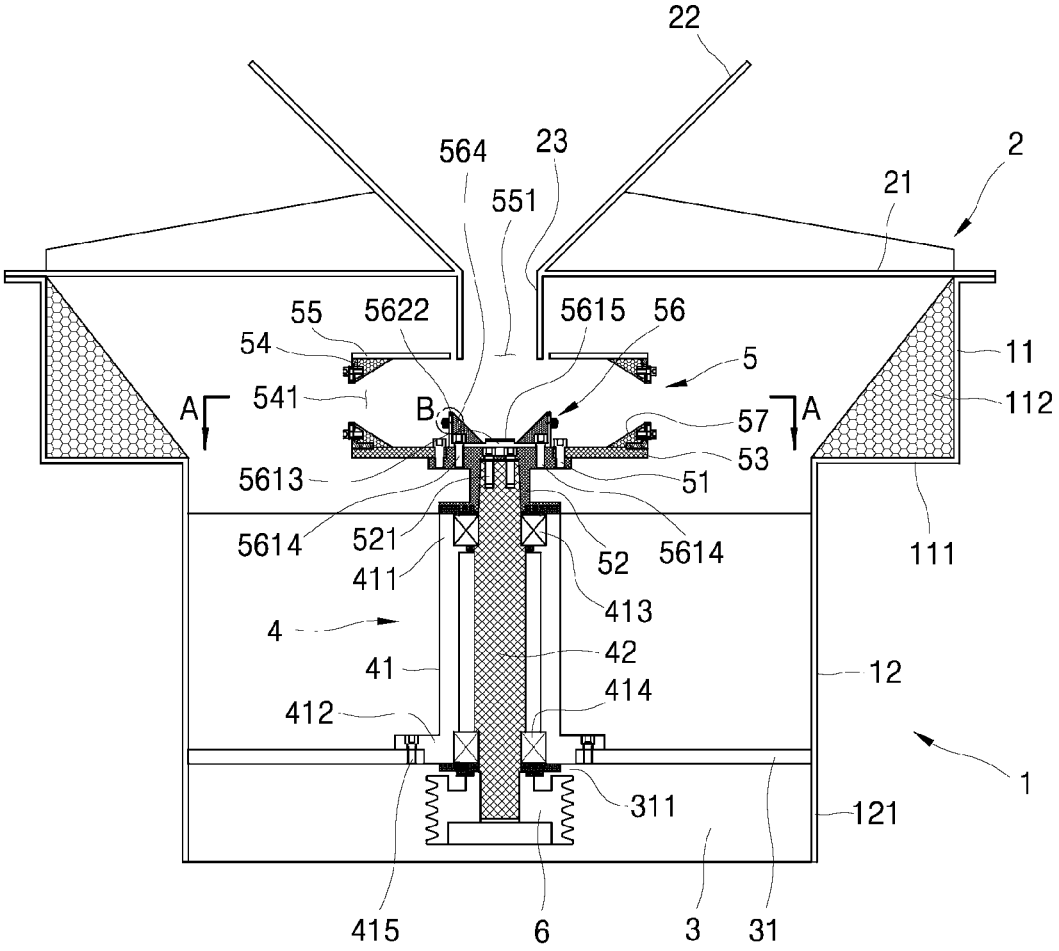
FIG. 4 is a cross-sectional view of a vertical shaft impact crusher according to a preferred embodiment of the present invention.
Figure 5:
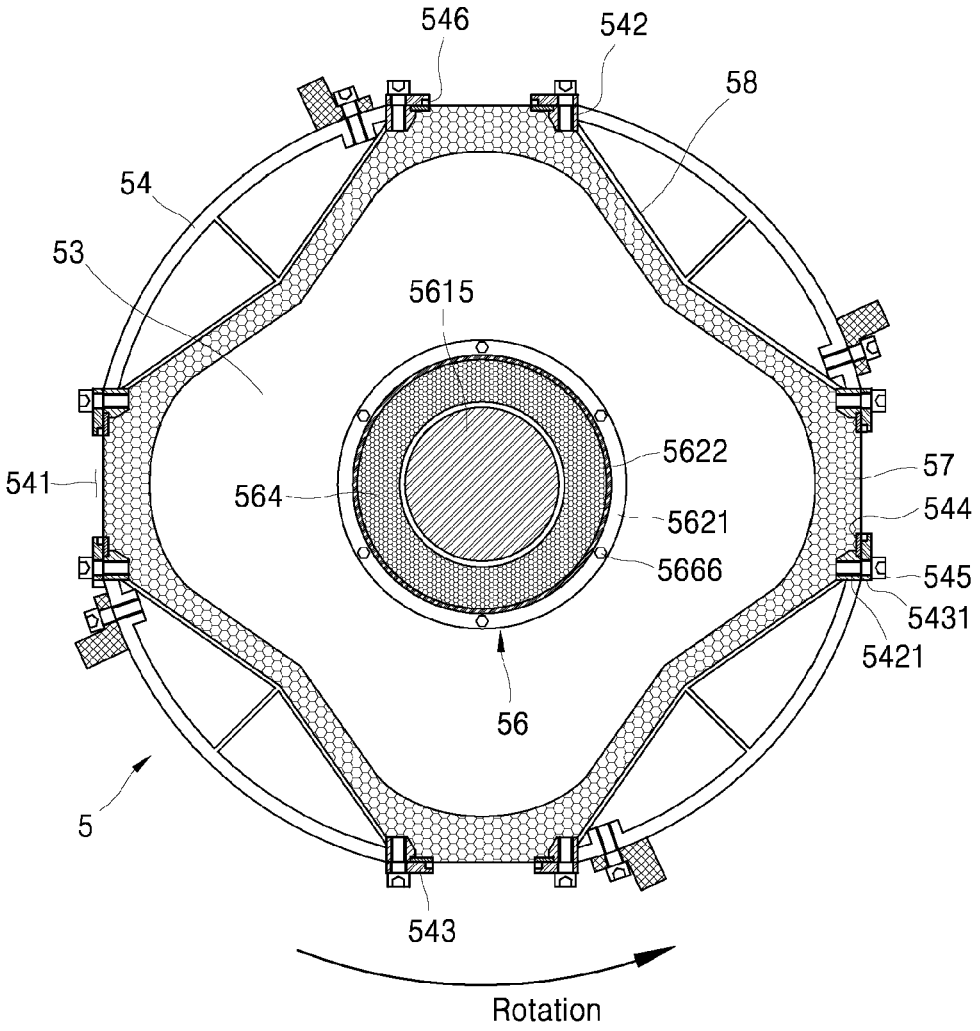
FIG. 5 is a plan view seen from above after the rotor is cut along a line A-A of FIG. 4.
Figure 6:
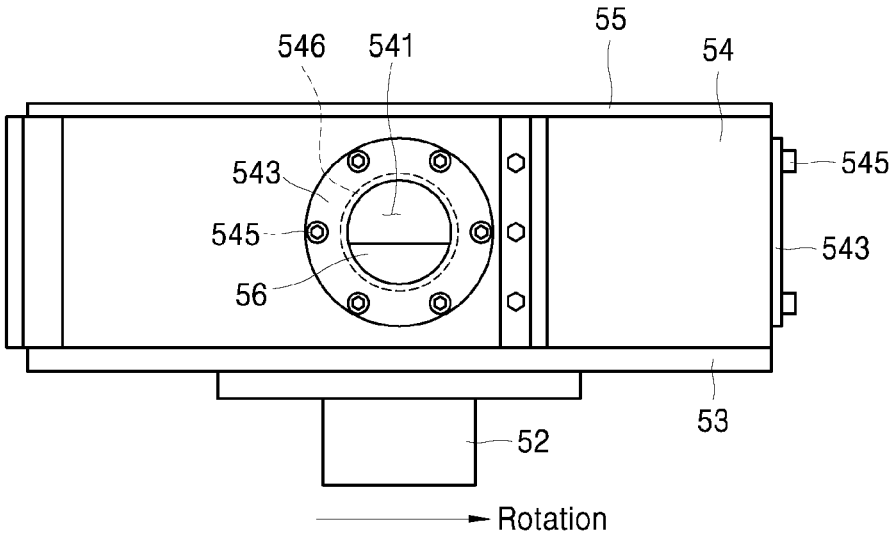
FIG. 6 is a front plan view of the rotor of FIG. 4.
Figure 7:
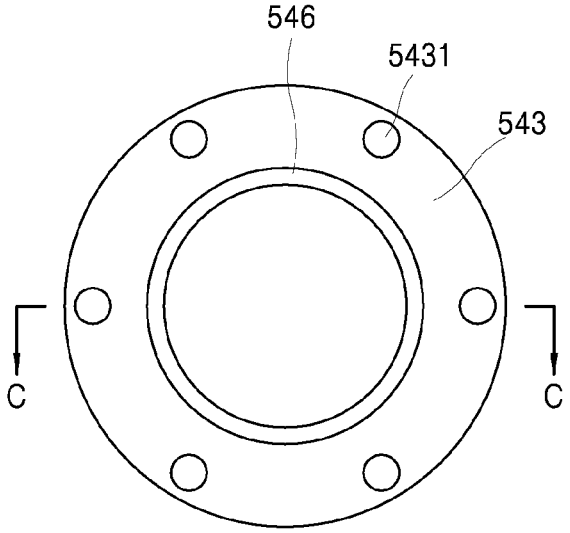
FIG. 7 is a front plan view illustrating the extra hard alloy tip ring which is coupled with a wear-resistant tip ring housing of FIG. 6.
Figure 8:
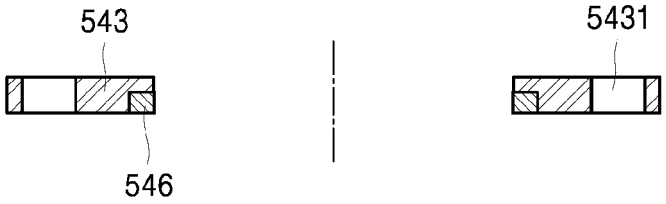
FIG. 8 is a cross-sectional view of FIG. 7 along a line C-C.
Figure 9:
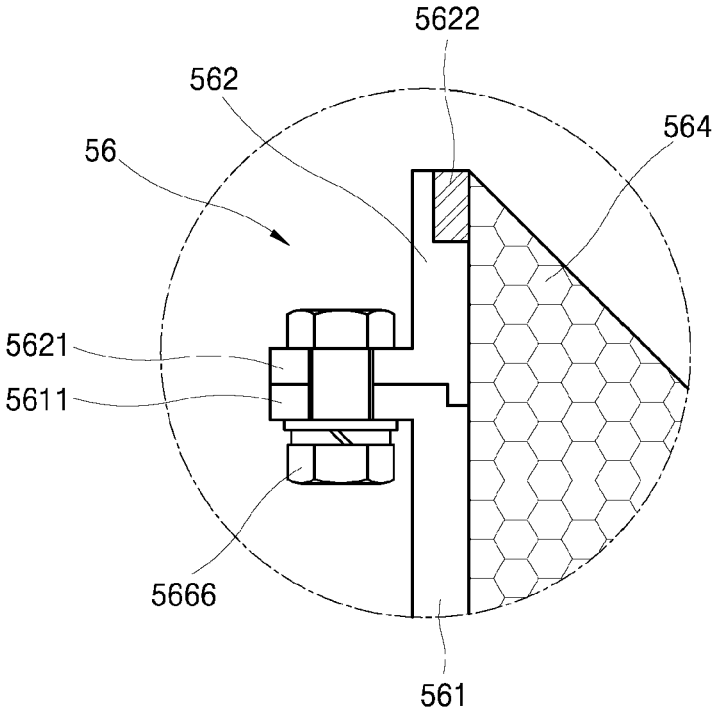
FIG. 9 is an expanded view of a B portion of FIG. 4.

FIG. 4 is a cross-sectional view of a preferred embodiment of the present invention, FIG. 5 is a plan view seen from above after the rotor is cut along a line A-A of FIG. 4, FIG. 6 is a front plan view of the rotor of FIG. 4, FIG. 7 is a front plan view illustrating the extra hard alloy tip ring which is coupled with a wear-resistant tip ring housing of FIG. 6, FIG. 8 is a cross-sectional view of FIG. 7 along a line C-C, and FIG. 9 is an expanded view of a B portion of FIG. 4.

[Frame]

When referring to FIG. 4, the vertical shaft impact crusher as one embodiment of the present invention comprises a frame 1. The frame 1 consists of an upper frame 11 and a lower frame 12. The upper frame 11 and the lower frame 12 has a cylindrical shape and a diameter of the upper frame 11 is greater than a diameter of the lower frame 12. Also, a stepwise portion 111 is formed under the upper frame 11 with a width corresponding to a height difference between the upper frame and the lower frame. An object to be crushed, which is accelerated by a rotor to be explained in the following and comes out of the rotor, accumulates on the stepwise portion 111 to form a stoppage protective layer 112 of the upper frame 11 as shown in the figure.

An upper cover 2 is coupled on the upper frame 11 to block an inner space of the upper frame from outside. The upper cover 2 consists of an upper cover plate 21, whose end portion is engaged on the upper frame, a hopper 22, which is formed at a center portion of the upper cover plate to guide the object to be crushed into the frame, and an injection chute 23 which extends downwards from a bottom of the hopper and serves as a guide for inserting the object to be crushed into the rotor 5 to be explained in the following.

A pulley chamber 3, which is formed in a shape corresponding to an inverted channel, is arranged inside a lower end portion 121 of the lower frame 12, and an aperture (not shown in the figure) is formed by removing a portion of the lower frame 12 at one side end of the pulley chamber 3, such that a V belt (not shown in the figure) is introduced from an operation means outside the frame to be connected with a pulley 6 which is disposed inside the pulley chamber 3. A pulley chamber upper plate 31, which is made of a rigid iron plate, is formed on the pulley chamber 3 to cover the pulley chamber, and a circular pulley chamber upper plate hole 311 is formed at a center portion of the pulley chamber upper plate.

[Rotation Shaft Assembly]

A rotation shaft assembly 4 is firmly engaged on the pulley chamber upper plate 31 by means of a bearing housing assembly bolt 415. More specifically, the rotation shaft assembly 4 includes a vertically arranged shaft 42 and a bearing housing 41 enclosing the shaft 42, and a flange, which is formed at a lower end portion 412 of the bearing housing, is engaged with the pulley chamber upper plate 31 by means of the bearing housing assembly bolt 415, such that the rotation shaft assembly 4 is firmly fixed on the pulley chamber upper plate 31. If a stepped portion protruding downward is formed on the flange, which is formed on the lower end portion 412 and the stepped portion is inserted into the pulley chamber upper plate hole 311, a position of the bearing housing 41 can be easily aligned with respect to the pulley chamber upper plate 31 and an engaging force between the bearing housing 41 and the pulley chamber upper plate 31 can be increased.

An upper bearing 413 is installed on an upper end portion 411 of the bearing housing 41, while a lower bearing 414 is installed on a lower end portion 412 of the bearing housing 41, and upper and lower portions of the shaft 42, which are inserted into the bearing housing 41, are supported by the upper bearing 413 and the lower bearing 414, respectively, while rotating in the bearing housing 41.

Also, an upper end and a lower end of the shaft 42, which are inserted into the bearing housing 41, protrude upward and downward more than the top and bottom of the bearing housing 41, respectively.

The pulley 6 is installed at the lower end of the shaft 42 protruding downward, and the pulley 6 is arranged in the pulley chamber 3 through the aforementioned pulley chamber upper plate hole 311. Since the pulley 6, which is arranged in the pulley chamber 3, is isolated from the inner space of the frame 1 by means of the pulley chamber upper plate 31, it is possible to prevent the object to be crushed, which is crushed near the stoppage protective layer 112 of the upper frame 11, from entering the pulley chamber 3 to affect the operation of the pulley 6.

The rotor to be explained in the following is engaged with the upper end of the shaft 42 which protrudes upward.

Meanwhile, a labyrinth seal for preventing dusts or an oil seal for maintaining grease is installed on the upper end, the lower end, etc. of the bearing housing 41; however, more detailed explanation on them is omitted since these are commonly known components widely used in the rotation shaft configuration.

[Rotor]

A rotor 5 is coupled with the upper end of the shaft 42 such that a center of the rotor 5 is aligned with a center of a rotation axis. Thus, the rotation shaft, which is the center of the rotor 5, is aligned with the rotation axis of the shaft 42, and the rotor 5 rotates in one entity as the shaft 42 rotates.

When looking further into the coupling configuration, the rotor 5 includes a rotor boss 52 at a lower center portion thereof, and a shaft coupling bolts 521 couple the rotor boss 52 with the shaft 42. A rotor lower plate 53 is coupled with the rotor boss 52, which is coupled with the shaft 42, by means of a rotor coupling bolt 51, which results in the rotor 5 being coupled with the shaft 42. A lower end of the rotor boss 52 has a shape for covering the upper portion 411 of the bearing housing 41 as shown in FIG. 4, and thus prevents fragments, etc. of a crushed rock from entering the bearing housing 41. It is needless to mention that a lower end of the rotor boss 52 is spaced apart from the upper end portion 411 of the bearing housing 41 by a tiny gap, and therefore there is no interference between the lower end of the rotor boss 52 and the upper end of the bearing housing 41 when the rotor boss rotates.

The rotor boss 52 has a stepped portion, which protrudes upward, and an annular inner circumferential surface of the rotor lower plate 53 is inserted into and coupled with the stepped portion as shown in FIG. 4. This configuration is similar to the coupling configuration for the aforementioned stepped portion of the bearing housing lower end portion 412 and the pulley chamber upper plate hole 311, and also provides the effects of an easy alignment as well as a strong engagement force between two components.

A rotor side wall 54 with a circular cylinder shape is coupled with a circumference of the circular rotor lower plate 53 by the conventional method, and an end portion of the circular (more strictly, annular) rotor upper plate 55 is also coupled with the upper end of the rotor side wall 54 by the conventional method. A plurality of circular holes 541 are equidistantly formed at the same height on a perimeter of the rotor side wall 54. Also, a circular rotor upper plate hole 551 is formed at a center portion of the rotor upper plate 55, and the aforementioned injection chute 23 penetrates a little into the rotor upper plate hole 551 as shown in FIG. 4. Since the injection chute 23 is stationary and the rotor upper plate 55 rotates, it is needless to mention that it is preferred that the injection chute 23 does not touch or interfere with an inner circumferential surface of the rotor upper plate hole 551 of the rotor upper plate 55.

A distribution tube 56 is firmly coupled with an upper surface of the rotor boss 52, which is disposed immediately under the injection chute 23, by means of a distribution tube coupling bolts 5614. The distribution tube 56 has a shape such that a bottom of the distribution tube is blocked and the distribution tube has a sidewall of a circular cylinder shape along a perimeter thereof. The distribution tube coupling bolts 5614 penetrates a bolt hole formed at a distribution tube bottom plate 5613, which forms the bottom of the distribution tube 56, to be engaged with the upper surface of the rotor boss 52. Here, the distribution tube coupling bolts 5614 penetrate the distribution tube bottom plate 5613 and are located to be near the sidewall. Then, head portions of the distribution tube coupling bolts 5614 are hidden inside the distribution tube protective layer 564, which is to be explained in the following, which prevents the head portions of the distribution tube coupling bolts 5614 from being worn by the object to be crushed which is inserted into the rotor.

A portion, which forms the sidewall of the distribution tube 56, is divided into a lower distribution tube 561 and an upper distribution tube 562 as shown in FIG. 9. And, coupling flanges 5611 and 5621 with a shape protruding outward are formed at a portion where the lower distribution tube 561 and the upper distribution tube 562 meet each other. Therefore, the lower distribution tube 561 and the upper distribution tube 562 are stacked one over the other to be coupled with each other by engaging the coupling flanges 5611 and 5621 with each other by means of the upper and lower distribution tube coupling bolts 5666. Since the coupling flanges are formed outside at a lower position than the upper end of the upper distribution tube, no object to be crushed flies to collide with the coupling flanges.

When the rotor rotates and the object to be crushed is inserted into the rotor, the crushed object accumulates in a funnel-like shape by the centrifugal force within the distribution tube 56 to form the distribution tube protective layer 564 as shown in FIG. 4. This distribution tube protective layer 564 completely prevents the crushed object from touching the bottom of the rotor, and thus protects the bottom of the rotor from wearing.

The distribution tube protective layer 564 is not formed at a center portion of the distribution tube bottom plate 5613 and the center portion is exposed. Then, the distribution tube bottom lining 5615 made of an extra hard alloy, etc. can be formed on the upper surface of the center portion, such that the center portion of the distribution tube bottom plate 5613 can be protected from being worn by the object to be crushed which is inserted through the injection chute 23.

Also, a distribution tube top lining 5622 made of an extra hard alloy, etc. is also formed on an upper inner circumferential surface of the upper distribution tube 562 among a vertical tube portion of the distribution tube 56. Since a diameter of the distribution tube is not large, a main speed (a linear velocity of the vertical tube portion of the distribution tube) is not high even when the rotor 5 rotates at a normal speed. Therefore, the wearing operation due to the collision of the crushed object is also weak. As a result, a lifespan of the rigid linings 5615 and 5622, which are applied on the distribution tube 56, comes to be very long. When the lifespan is explained in more detail, it can be said that the distribution tube top lining 5622, which is spaced apart from the center of the rotor by a small distance, usually experiences more wearing. The reason of dividing the sidewall portion of the distribution tube into the upper distribution tube and the lower distribution tube is that, when the lining 5622 formed at an upper inner circumferential surface of the upper distribution tube 562 is completely worn out, only the upper distribution tube portion can be replaced without replacing a whole part of the distribution tube 56. The technical feature to be noted here is that, when the distribution tube 56 consists of the upper distribution tube and the lower distribution tube as separate entities as for the present invention, convenience is improved by only replacing the upper part of the distribution tube, and there is no need to break down the distribution tube protective layer 564 in order to access the head portion of the distribution tube coupling bolts 5614 which are hidden in the distribution tube protective layer 564. That is to say, by adopting a configuration in which the upper part of the distribution tube 56 can be replaced separately, it is possible to minimize the degree of breakdown of the distribution tube protective layer 564 during the replacement process of the distribution tube. As a result, according to the present invention, since each of the aforementioned rigid linings can be replaced separately according to the degree of wearing, utilization efficiency of the linings is improved, and replacement and maintenance processes can be facilitated due to the improved configuration.

Figure 12:
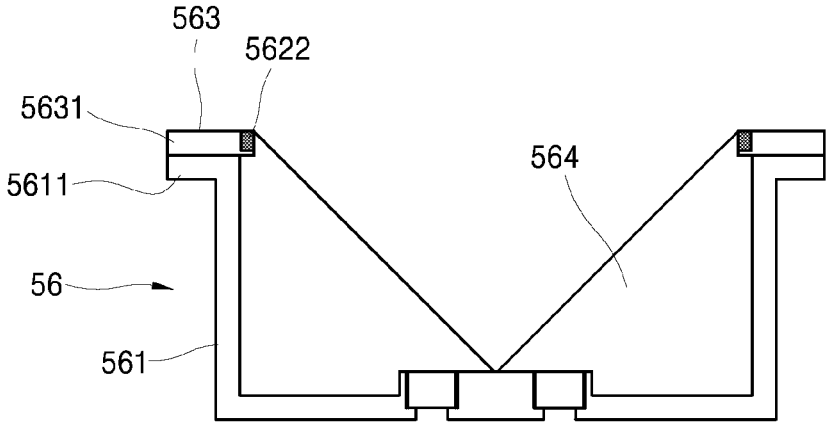
FIG. 12 is another embodiment of a distribution tube which is installed on the rotor according to the present invention.

Although FIG. 4 and FIG. 9 illustrate the distribution tube 56, which is divided into two portions, that is, the lower distribution tube 561 and the upper distribution tube 562, the configuration, in which the distribution tube 56 is divided into two parts such that portions to be replaced can be replaced separately, is not restricted to the shown embodiments. For example, it is also possible to configure the distribution tube to be divided into a lower distribution tube 561 and an upper ring 563 as shown in FIG. 12. The distribution tube shown in FIG. 12 is different from the distribution tubes shown in FIG. 4 and FIG. 9 by the shapes of the upper ring 563 and the upper distribution tube 562 which constitute the upper portion. The upper ring 563 has a planar circular ring shape and a coupling surface 5631, which is engaged with a coupling flange 5611 of the lower distribution tube 561, is formed at an outer diameter of the ring. Also, an inner diameter of the upper ring 563 is equal to or smaller than the inner diameter of the lower distribution tube 561, and a ring-shaped distribution tube top lining 5622 is formed at a periphery of an upper edge of an inner diameter portion of the upper ring 563. The distribution tube 56, which is configured as explained, also performs the same function as the distribution tubes shown in FIG. 4 and FIG. 9, and therefore the component to be replaced frequently (e.g. an upper ring) can be manufactured more easily. Meanwhile, when the distribution tube protective layer 564 is formed by the distribution tube 56, a centrifugal force is exerted on the object to be crushed which is inserted into the center of the rotor 5, which makes the object to be crushed, which is apart from the center of the rotor by a small distance, rise along an inclined surface to reach the upper end of the distribution tube, and then be further accelerated by the centrifugal force to fly toward the rotor side wall 54. Therefore, the effects of installing the distribution tube 56 are as follows: First, since the distribution tube protective layer 564 is formed to prevent the wear due to a direct contact between the upper surface of the rotor lower plate 53 and the crushed object, the rotor lower plate can be used permanently without being replaced. Second, since the direction of flight of the crushed object which is accelerated by the centrifugal force can be determined by adjusting an upper end height of the distribution tube 56, when the upper end of the distribution tube is formed to be slightly lower than a position at a height corresponding to half the height of the rotor side wall 54, it is possible to control the direction of flight of the object to be crushed, which is inserted into the center of the rotor 5 and accelerated, to substantially point at a predetermined area around the position at a height corresponding to half the height of the rotor side wall. The particles, which escape from the upper end of the distribution tube, come to fly in a direction of the sum vector of a vector of the inclined surface of the distribution tube protective layer 564 and the vector of the centrifugal force direction exerted on the particles.

Next, the circular hole and a relevant configuration formed at the rotor side wall will be explained by referring to FIGS. 5-8. Four circular holes 541 are radially formed equidistantly on the rotor side wall 54 around the rotation center of the rotor. A wear-resistant tip ring housing support ring 542 having tap holes 5421 is firmly engaged with the circumference of the circular hole 541 in one entity by way of welding, etc. A plurality of tap holes 5421 of the wear-resistant tip ring housing support ring 542 are formed equidistantly along the circumference of the circular hole 541. That is, for example, four or six tap holes are formed (six tap holes are shown in the figures). A ring-shaped wear-resistant tip ring housing 543 is engaged with an outer surface of the wear-resistant tip ring housing support ring 542. And, since the wear-resistant tip ring housing 543 also has bolt holes 5431 at positions corresponding to the tap holes 5421 of the wear-resistant tip ring housing support ring 542, they can be engaged with each other by means of coupling bolts 545. Also, the number of the bolt holes 5431 formed in the wear-resistant tip ring housing 543 can be equal to the number of the tap holes 5421, or double the number of the tap holes 5421. For example, when the number of the tap holes 5421 is four and the number of bolt holes 5431 is also four, the wear-resistant tip ring housing 543 can be engaged with the wear-resistant tip ring housing support ring 542 at four angles; however, it can be understood that when the number of the tap holes 5421 is four and the number of bolt holes 5431 is twelve, the wear-resistant tip ring housing 543 can be engaged with the wear-resistant tip ring housing support ring 542 at twelve angles.

A wear-resistant tip ring 546, which is made of a wear-resistant material such as an extra hard alloy, etc., is housed at an inner edge portion of the inner diameter portion of the wear-resistant tip ring housing support ring 542. Therefore, when seen from an inner portion of the rotor to outside through the circular hole 541, the wear-resistant tip ring 546 can be positioned on an inner periphery of the circular hole 541, where the particles, which are accelerated to be discharged to outside through the circular hole 541, collide, and it is thus possible to protect a portion that can be worn in the rotor.

Also, since the crushed object, which is accelerated to be discharged to outside by the centrifugal force, escapes from a 3 o'clock portion or a 9 o'clock portion according to the rotating direction of the rotor, the portions of the wear-resistant tip ring 546 which are located at the corresponding portions come to experience intensive wearing. More specifically, a funnel-shaped protective layer is formed on an inner surface of the circular hole 541 around the circular hole in an inner space of the rotor by the centrifugal force. Then, the funnel-shaped protective layer formed as above can be formed as a valley at a center height portion of the circular hole 541 according to the shape (a half height portion of the circle is the farthest portion from the rotation center of the rotor) of a circle of the circular hole 541 and the centrifugal force, and, therefore, the valley portion comes to be located at a farther position from the rotation center of the rotor. As a result, the crushed object, which escapes from the distribution tube 56 and reaches the rotor protective layer 57, is moved toward the valley portion, and then the centrifugal force is exerted again on the crushed object to move the crushed object toward the circular hole, which results in the crushed object escaping from the 3 o'clock direction portion or a 9 o'clock direction portion of the circular hole 541. According to this configuration, irrespective of the position where the crushed object first reaches the rotor protective layer, the crushed object is moved by the centrifugal force to pass through the valley portion to be guided into the a 3 o'clock or the 9 o'clock direction position of the circular hole, and then leaves the rotor while touching the wear-resistant tip ring made of an extra hard alloy. Therefore, the positions and the degrees of wearing on the wear-resistant tip ring are accurately same for all apertures, which prevent vibrations from being generated in the rotor which is rotating at a high speed.

For example, when the rotor 5 rotates in the rotating direction as shown in FIG. 6, the 9 o'clock direction portion shown in the figure among the perimeter portions of the wear-resistant tip ring 546 will be intensively worn. When the wearing progresses and the wear-resistant tip ring portion is worn to a limiting point, the coupling bolts 545 are released, the wear-resistant tip ring housing 543 is rotated by one spacing between the bolt holes 5431, and then the coupling bolts are engaged again. Then, the portion of the wear-resistant tip ring 546, which is not worn, is positioned on the 3 o'clock direction portion or the 9 o'clock direction portion, which results in a uniform wearing of the wear-resistant tip ring as well as a greatly elongated lifespan of the wear-resistant tip ring. This configuration can be realized by the fact that the holes are circular holes 541 and particles are intensively accelerated to move along a predetermined position (a 3 o'clock or a 9 o'clock direction) and that the wear-resistant tip ring housing, which is coupled with the circular hole, is also circular which makes it possible to engage the wear-resistant tip ring housing 543 with the circular hole 541 while rotating the wear-resistant tip ring housing.

As explained in the above, the rotor protective layer 57 is formed in an inner portion of the rotor 5 which is surrounded by the rotor side wall 54 and the rotor upper plate 55 and the rotor lower plate 53 adjacent to the rotor side wall as shown in FIG. 4 and FIG. 5, and the rotor protective layer is formed by the crushed object which is inserted into the rotor 5 and accumulated by the centrifugal force. When the rotor protective layer 57 of a predetermined shape is formed, the particles, which fly from the center of the rotor 5 toward the rotor side wall 54 by the centrifugal force, do not collide directly with the rotor side wall, the rotor upper plate, and the rotor lower plate, and they rather come to collide with the rotor protective layer 57, which prevents the side wall, the upper plate, or the lower plate from being worn due to the collision with the particles. Since the rotor protective layer 57 is formed in a shape similar to the funnel shape centered at the circular hole 541, rather than the wave-patterned protective layer formed on the conventional rotor, the rotor protective layer can cover not only the rotor side wall 54 but also the rotor upper plate 55 and the rotor lower plate 53, which are connected with the rotor side wall at upper and lower portions, respectively. Therefore, the bottom and the ceiling of the rotor as well as the rotor side wall can be completely protected by the rotor protective layer.

According to the present invention, a washer-shaped partition ring 544 is sandwiched between the wear-resistant tip ring housing 543 and the wear-resistant tip ring housing support ring 542 and an inner diameter of the partition ring 544 is smaller than the an inner diameter of the wear-resistant tip ring housing support ring 542 and substantially equal to the inner diameter of the wear-resistant tip ring housing 543 as shown in FIG. 5, such that the rotor protective layer 57, which is made of the crushed object, is formed not on the inner surface of the wear-resistant tip ring housing 543 but on the inner surface of the partition ring 544. Since the crushed object which constitutes the rotor protective layer 57 has tiny particles and contains much moisture, it can form an extremely strong protective layer when consolidated by the strong centrifugal force generated in the rotor 5, and since the object to be crushed also has an adhesive property, when the rotor protective layer is consolidated, the protective layer is attached to the constituents touching the rotor protective layer 57 with an extremely strong adhesive force. As explained above, the 3 o'clock direction portion or the 9 o'clock direction portion of the wear-resistant tip ring 546 experiences severe wearing, and the wear-resistant tip ring housing 543 should be disassembled in order to rotate the wear-resistant tip ring housing 543 by a predetermined angle and then reinstall the wear-resistant tip ring housing, it would be very hard to separate the wear-resistant tip ring housing 543 from the rotor protective layer 57 when the wear-resistant tip ring housing 543 adjoins the rotor protective layer 57 having a strong adhesive force. In consideration of this situation, the present invention disposes the partition ring 544 between the wear-resistant tip ring housing 543 and the rotor protective layer 57. Since the partition ring 544 prevents the rotor protective layer 57 from directly adjoining the wear-resistant tip ring housing 543 according to the present invention, the worn wear-resistant tip ring 546 can be easily separated when the wear-resistant tip ring is to be rotated or separated. Also, even when the wear-resistant tip ring housing 543 is to be disassembled, since the partition ring 544 supports the rotor protective layer 57 while being attached to the rotor protective layer 57, a dynamic balance of the rotor 5 can be maintained after the wear-resistant tip ring housing 543 is disassembled and then assembled again by preventing the rotor protective layer 57 from being damaged while the wear-resistant tip ring housing 543 is separated. In addition, since the inner diameter of the partition ring 544 coincides with the inner diameter of the wear-resistant tip ring housing 543, the partition ring 544 at a corresponding portion still supports the rotor protective layer 57 while maintaining its shape even when a wearing portion of the wear-resistant tip ring 546 is located in other directions than the 3 o'clock or 9 o'clock direction after the wear-resistant tip ring housing 543 is disassembled and assembled again, which further prevents the balance of the rotor protective layer 57 from being badly affected even after the wear-resistant tip ring housing 543 is disassembled and assembled again. In the meantime, although the 3 o'clock or 9 o'clock direction on the partition ring 544 can experience wearing while the rotor rotates, a portion of the wear-resistant tip ring 546, which is not worn, can be disposed at the worn direction by disassembling, rotating, and assembling the wear-resistant tip ring 546 again, which applies little effect on the balance of the rotor protective layer 57. However, the partition ring 544 can also be replaced when necessary, and, therefore, the partition ring 544 according to the present invention is provided as a separate structure apart from the wear-resistant tip housing support ring 542. Also, when the outer diameter of the partition ring 544 is configured to be substantially equal to an inner diameter of the stepped portion formed on the wear-resistant tip ring housing support ring 542 as shown in FIG. 5, the installation position of the partition ring can be set easily.

The aforementioned wear-resistant tip ring 546 is configured to protect a rim portion of the hole 541 in an operation environment causing the severe wearing. In other words, it can be understood that the wear-resistant tip ring should not necessarily be made of an extra hard alloy material and may not be installed at all in an operation environment causing less wearing, such as when the object to be crushed is relatively large and a frictional area between the rotor and the object to be crushed, which is the cause of wearing, is small. However, even in the case of causing less wearing, it will be much easier to reinforce a worn portion or take other measures when compared to the conventional rotor, since a trajectory along with the object to be crushed travels in the rotor can be accurately controlled attributed to the shape of the circular hole. Therefore, in addition to the efficient use of the wear-resistant tip ring, the circular hole is technically important on its own. Meanwhile, since a mass of the rotor protective layer 57, which is formed in an inner space of the rotor 5, is decreased by installing a partition 58 between the rotor protective layer 57 and the rotor side wall 54 as shown in FIG. 5, the power required for rotating the rotor 5 can be reduced (to the contrary, when no partition is provided, a vacant space, which is surrounded by the partition, will be filled with the crushed object and the mass of the protective layer will be increased).

Figure 11:
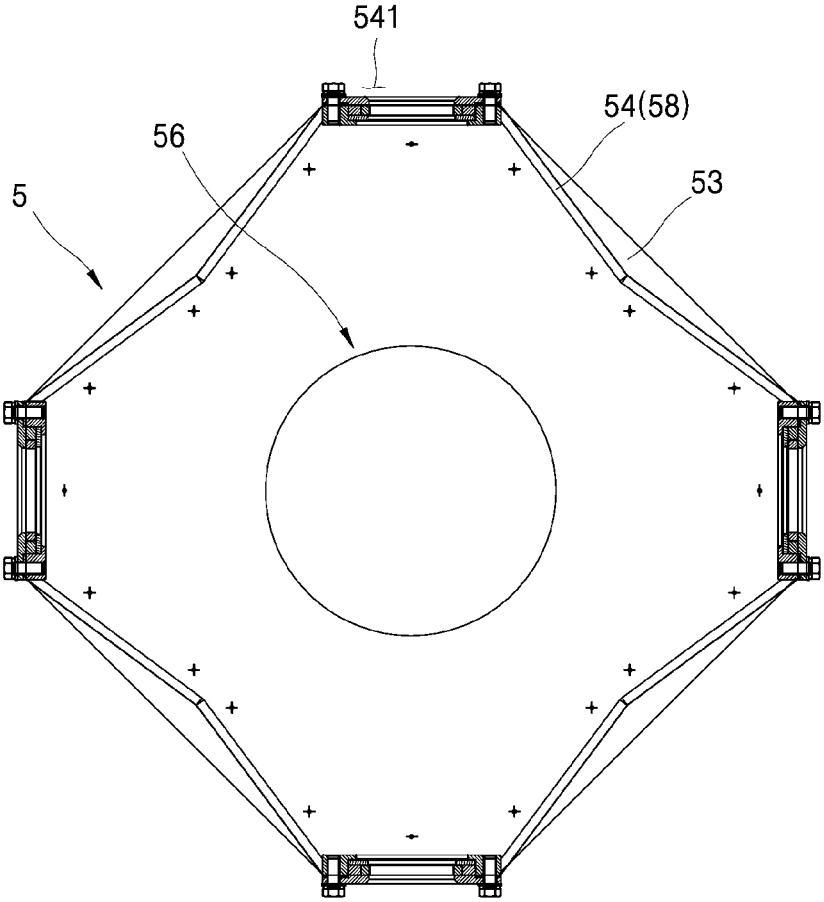
FIG. 11 shows another embodiment of the rotor according to the present invention.

It is also possible to further develop this technical feature such that the rotor upper plate 55, the rotor lower plate 53, and the rotor side wall 54 are configured as shown in FIG. 11. That is, although the rotor 5 shown in FIG. 5 and FIG. 6 has the rotor upper plate 55, the rotor lower plate 53 having circular shapes, the rotor side wall 54 having a cylinder shape, and a separate partition 58 within the rotor side wall 54, it is possible to configure the rotor upper plate (not shown in the figure) and the rotor lower plate 53 in a regular quadrilateral shape, arrange the circular holes 541 at vertex portions of the regular quadrilateral shape, and form the rotor side wall 54 in the shape of the partition 58 as shown in FIG. 11, such that the housing of the rotor can be formed in a simple and lightweight configuration.

In the following, operations of the aforementioned rotor and the vertical shaft impact crusher are explained.

The object to be crushed, which is inserted into the hopper 22, passes by the injection chute 23 and is inserted into the rotor 5 at a constant supply speed.

The object to be crushed, which is inserted into the inner portion of the rotor through a center portion of the upper plate 55 of the rotating rotor 5, is forced away from the center by the centrifugal force to collide with the distribution tube protective layer 564 formed inside the distribution tube 56 and then rise along the inclined surface of the distribution tube protective layer 564 to be accelerated. After escaping the upper end of the distribution tube 56, the object to be crushed collides with the rotor protective layer 57 and is abruptly accelerated to move along the surface of the rotor protective layer 57 toward the 3 o'clock or 9 o'clock direction (whether the object is accelerated to the 3 o'clock or 9 o'clock direction is determined according to a rotating direction of the rotor) of the circular hole 541, and then, finally, the object to be crushed comes to escape from the rotor 5 at a high speed (a linear velocity is the highest at the end of the rotor).

The particles, which have escaped from the rotor assembly 2, fly with a velocity vector having a direction tangential to the outer diameter of the rotor to forcefully collide with the stoppage protective layer 112, which is formed on the upper frame 11 and the stepwise portion 111, and then are crushed.

The crushed object falls down in a gravitational force direction along the inclined surface of the stoppage protective layer 112 to reach the lower frame 12, and it is guided to outside by the chute, etc.

With respect to a moving path of the crushed object, the object to be crushed inserted into the center portion of the rotor 5 moves to outside while adjoining the distribution tube protective layer 564, collides with the rotor protective layer 57 at a position controlled by the height of the distribution tube 56, and is accelerated. Then, the object to be crushed moves along the rotor protective layer 57 to fly outside and then collides with the stoppage protective layer 112 again to be crushed. Therefore, only a portion of the distribution tube bottom lining 5615, a portion of the distribution tube top lining 5622, and the 3 o'clock or 9 o'clock direction of the wear-resistant tip ring 546 directly touch the object to be crushed which is inserted into the rotor 5 in the configuration of the crusher.

According to the present invention, the moving path of the object to be crushed is accurately controlled as intended by using the configuration of the rotor to minimize the portion where the object to be crushed directly touches the inner configuration of the rotor, which extends a lifespan of the rotor by a great amount and facilitates the maintenance of the rotor. Also, it is apparent that no stabilization process is required after the maintenance process since the protective layer remains after the maintenance. In addition, other effects which are not described herein can be envisaged based on the apparent effects of the configuration of the present invention.

Figure 10:
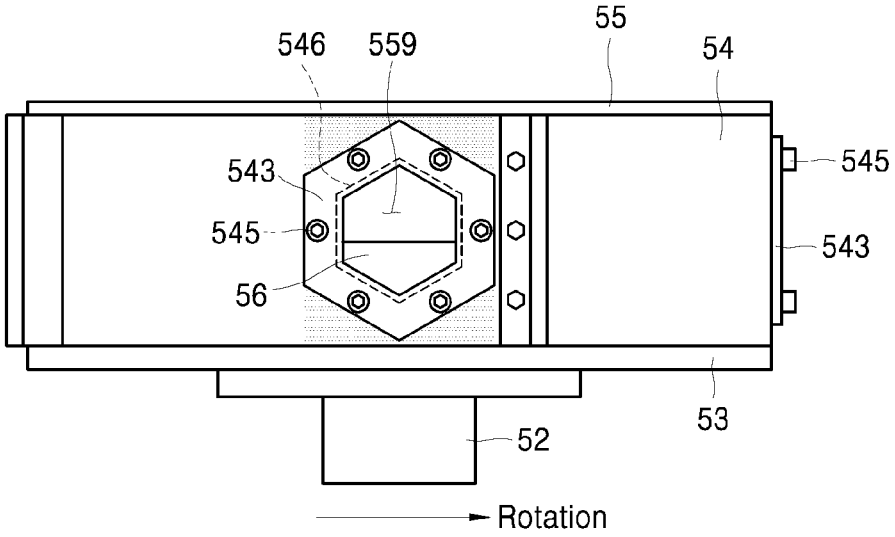
FIG. 10 is a front plan view of a rotor according to another embodiment of the present invention.

Although the present invention has been explained by referring to the appended figures as in the above, it is to be noted that the present invention is not restricted to the embodiments and figures disclosed with this specification, and that various modifications can be made by the person having an ordinary skill in the art within the scope of the technical spirit of the present invention. For example, when an equilateral polygon hole 59 (such as the regular hexagon hole as shown in FIG. 10) is formed instead of the aforementioned circular hole 541, a configuration having a rotor side wall 54 part, which is disposed at an area between the equilateral polygon hole 59 and the rotor lower plate 53 and the rotor upper plate 55 (refer to the shaded portion in FIG. 10) seen in an up-down direction of the polygon hole 59, can also be considered. In this case, in a similar manner, since a funnel-shaped rotor protective layer 57 is formed around the equilateral polygon hole 59 and a valley is formed around a portion of the rotor protective layer 57 with a height corresponding to half the height of the rotor side wall, the object to be crushed is made to escape from the 3 o'clock direction portion or the 9 o'clock direction portion of the equilateral polygon hole 59, which provides the effect similar to the effect of the case having the circular hole 541. Therefore, even the hole with an equilateral polygon shape rather than a circular shape can be considered to be equivalent to the circular hole since the effects are similar as well as the valley is formed around a portion with a height corresponding to half the height of the rotor side wall and the object to be crushed escapes to outside from the 3 o'clock direction portion or the 9 o'clock direction portion of the hole 59. In addition, although there is shown a vertical shaft impact crusher having a stoppage protective layer made of the object to be crushed, it is apparent that a vertical shaft impact crusher having a plurality of anvils as used in the field instead of the stoppage protective layer which are arranged in a circular shape also falls into the embodiments of the present invention. And, it is apparent that, although the effects according to the configuration of the present invention are not clearly written and described while explaining the embodiments of the present invention, any effect, which can be predicted by the corresponding configuration, can also be anticipated.

INDUSTRIAL APPLICABILITY

It is apparent that the aforementioned rotor and the vertical shaft impact crusher using the same are industrially applicable to the crushing field.

The invention claimed is:

1. A rotor for a vertical shaft impact crusher which rotates about a rotation shaft extending in a vertical direction and accelerates an object to be crushed by a centrifugal force, comprising:

a rotor upper plate including a rotor upper plate hole which is an inlet for the object to be crushed, which is inserted into the rotor, and forming an upper portion of the rotor, wherein the rotor upper plate hole is disposed at the center of the rotor upper plate;

a rotor lower plate disposed under the rotor upper plate to be spaced apart from the rotator upper plate and forms a bottom of the rotor;

a rotor side wall which is arranged between the rotor upper plate and the rotor lower plate to be coupled with the rotor upper plate and the rotor lower plate, and disposed at a position spaced apart from the rotor upper plate hole in a radial direction of a rotation center of the rotor;

a plurality of circular holes (541), which each is formed in the rotor and extends through the rotor side wall in the radial direction of the rotation center of the rotor, wherein each circular hole is tapered toward an outer sidewall of the rotor (5), wherein each circular hole is an outlet, through which the object to be crushed and accelerated by the rotor comes out of the rotor, wherein a center of the rotor upper plate hole (551) is aligned with a rotation axis of the rotor (5), wherein a center of the rotor (5) is aligned with the rotation axis of the rotor (5), wherein a first distance, when measured in the radial direction of the rotation center of the rotor, from the rotation axis of the rotor (5) to an inner edge of the rotor upper plate that forms the rotor upper plate hole (551) is shorter than a second distance, when measured in the radial direction of the rotation center of the rotor, from the rotation axis of the rotor (5) to each circular hole, wherein the radial direction of the rotation center of the rotor is perpendicular to the rotation axis of the rotor (5); and a plurality of wear-resistant tip rings, which each has a shape corresponding to a circular shape of each circular hole, is respectively detachably installed at a circumference of each circular hole, and wherein each wear-resistant tip ring is configured to be rotated at a different positions with respect to each circular hole.

2. The rotor according to claim 1, wherein each circular hole is formed at the same height equidistantly along an outer periphery of the rotor side wall.

3. The rotor according to claim 2, further comprising:

the wear-resistant tip ring which is detachably installed on the outer periphery of the rotor side wall (54) and at a circumference of the each circular hole (541).

4. The rotor according to claim 3, the wear-resistant tip ring has a shape corresponding to an arc shape of each circular hole.

5. The rotor according to claim 3, the wear-resistant tip ring is respectively installed at least in a 3 o'clock direction or a 9 o'clock direction on each circular hole.

6. The rotor according to claim 3, the wear-resistant tip ring is installed on an outer wall of the rotor side wall (54).

7. The rotor according to claim 1, wherein each wear-resistant tip, which has a shape corresponding to an arc shape of each circular hole, is detachably installed at least in a 3 o'clock direction or a 9 o'clock direction on each circular hole, respectively.

8. The rotor according to claim 1, wherein an inner diameter of each wear-resistant tip ring is smaller than an inner diameter of each circular hole.

9. The rotor according to claim 1, wherein each wear-resistant tip ring is coupled with a wear-resistant tip ring housing and each wear-resistant tip ring housing is respectively engaged with the circumference of each circular hole, which results in each of the wear-resistant tip rings being respectively installed on the circumference of each circular hole.

10. The rotor according to claim 9, wherein each wear-resistant tip ring (546) is respectively coupled, with an inner circumference of each wear-resistant tip ring housing (543).

11. The rotor according to claim 1, wherein is a plurality of tap holes are formed at the circumference of each circular hole, a plurality of bolt holes are formed on the wear-resistant tip ring or a wear-resistant tip ring housing with which the wear-resistant tip ring is engaged, and, even when the azimuth angle of the wear-resistant tip ring or the wear-resistant tip ring housing varies, at least some of the tap holes and the bolt holes are mated with one each other to engage coupling bolts, which enables the wear-resistant tip ring or the wear-resistant tip ring housing to be installed on the circumference of the each circular hole.

12. The rotor according to claim 1, wherein a wear-resistant tip ring housing support ring, which is separably coupled with the wear-resistant tip ring or a wear-resistant tip ring housing with which the wear-resistant tip ring is engaged, is coupled with the rotor side wall in one entity at an inner diameter of each circular hole.

13. The rotor according to claim 1, wherein the wear-resistant tip ring or a wear-resistant tip ring housing with which the wear-resistant tip ring is engaged is engaged with the circumference of each circular hole from outside the rotor side wall.

14. The rotor according to claim 13, wherein a partition ring is sandwiched between the circumference of each circular hole or a wear-resistant tip ring housing support ring, which is engaged with the circumference of each circular hole in one entity, and the wear-resistant tip ring or the wear-resistant tip ring housing.

15. The rotor according to claim 14, wherein an outer diameter of the partition ring is greater than the inner diameter of each circular hole or the wear-resistant tip ring housing support ring, and an inner diameter of the partition ring is smaller than the inner diameter of each circular hole or the wear-resistant tip ring housing support ring and is equal to or smaller than the inner diameter of the wear-resistant tip ring.

16. The rotor according to claim 1, wherein the rotor side wall (54) consisting of folded bracket-shaped wall pieces to form a polygon shape, wherein each of the folded bracket-shaped wall pieces extends between two neighboring circular holes (541), wherein a fold line of each of the folded bracket-shaped wall pieces protrudes towards the rotation center of the rotor (5).

17. The rotor according to claim 16, further comprising:

a distribution tube (56) provided around the rotation center of the rotor (5) and surrounded by the rotor side wall (54).

18. The rotor according to claim 1, further comprising:

a folded bracket-shaped partition (58) provided in the rotor side wall (54) and extending between two neighboring circular holes (541), wherein a fold line of the folded bracket-shaped partition (58) protrudes towards the rotation center of the rotor (5), a distribution tube (56) provided around the rotation center of the rotor (5) and surrounded by the folded bracket-shaped partition 58).

19. The rotor according to claim 1, further comprising:

a folded bracket-shaped partition (58) is provided in the rotor side wall (54) and extending between two neighboring circular holes (541), wherein a fold line of the folded bracket-shaped partition 58 protrudes towards the rotation center of the rotor (5), wherein the first distance is shorter than a third distance, when measured in the radial direction of the rotation center of the rotor, from the rotation axis of the rotor (5) to the folded bracket-shaped partition (58).

* * * * *